United States Patent [19]

Bowling et al.

[11] Patent Number: 4,503,406

[45] Date of Patent: Mar. 5, 1985

[54] INSIDE COLLET FOR COAXIAL PLACEMENT OF DIODE

[75] Inventors: Donald R. Bowling; Charles F. Smith, both of Ridgecrest, Calif.

[73] Assignee: The United States of America as represented by the Secretary of the Navy, Washington, D.C.

[21] Appl. No.: 510,794

[22] Filed: Jun. 30, 1983

[51] Int. Cl.[3] ..... H01P 1/00

[52] U.S. Cl. ..... 333/245; 331/107 DP; 333/99 R

[58] Field of Search ..... 333/245, 260, 99 R; 329/160–162, 203, 204, 205 R, 205 TD; 361/417, 418; 331/107 DP

[56] References Cited

U.S. PATENT DOCUMENTS

| | | | |
|---|---|---|---|
| 1,973,322 | 9/1934 | Staples | 173/263 |
| 2,917,722 | 12/1959 | Cobbett et al. | 339/59 |
| 3,163,393 | 12/1964 | Strong, Jr. | 361/418 X |
| 3,320,575 | 5/1967 | Brown et al. | 339/268 |
| 3,444,505 | 5/1969 | Becker | 339/94 |
| 3,457,542 | 7/1969 | Wolf | 339/89 |
| 3,541,480 | 11/1970 | Tenenholtz | 333/245 |
| 3,798,586 | 3/1974 | Huska | 339/89 R |
| 3,997,232 | 12/1976 | Dunaway | 339/94 R |

*Primary Examiner*—Paul Gensler

*Attorney, Agent, or Firm*—R. F. Beers; W. Thom Skeer; Stephen J. Church

[57] ABSTRACT

An inside collet assembly for positioning an IMPATT diode precisely axially along and coaxially of a cylindrical cavity. The assembly serves for convenient removal and repositioning of the diode within the cavity and provides effective electrical and thermal connection to the diode. The assembly is not significantly larger in diameter than the cavity and does not require surfaces producing undesired reflections of microwaves within the cavity.

7 Claims, 5 Drawing Figures

INSIDE COLLET FOR COAXIAL PLACEMENT OF DIODE

BACKGROUND OF THE INVENTION

1. Field of the Invention

This invention pertains to an inside collet for coaxial placement of a diode. More particularly, this invention pertains to a collet assembly for precisely positioning an electronic device axially along a cylindrical bore in coaxial relation thereto and in electrical and thermal connection with an element through which the bore extends.

2. Description of the Prior Art

IMPATT diodes are well known for their use in microwave oscillators. Each such diode, typically, is of a cylindrical configuration with one end being one terminal of the diode and the opposite end portion being externally screw threaded. A flange circumscribes the diode between such end and such end portion, and the flange and the end portion serve as the other terminal of the diode. When so used, the diode is, typically, disposed coaxially in a cylindrical bore having a transformer, which is a cylindrical slug disposed coaxially in the bore, insulated electrically therefrom, and presenting an axial end surface through which electrical connection is made to the one terminal of the diode. The diode, for test purposes, may be used individually with transformers of various axial lengths so that it is necessary to vary the axial position of the diode in the bore. As the diode position varies, the one terminal must remain effectively connected electrically to the transformer while the other terminal remains effectively connected to an element providing the bore both electrically and thermally for dissipation of heat from the diode.

Prior art arrangements for so mounting an IMPATT diode have included shims, which are inconvenient since they must be changed for use with different transformers and only position the diode at predetermined positions, and springs, which are received coaxially in the bore and which result in poor electrical contact since the small diameter of the bore of, typically about ⅛ inch (3 mm), does not permit the use of springs exerting sufficient force. Other prior art arrangements have included collars disposed in circumscribing relation to the diode and screw threads within the bore in the immediate vicinity of the diode. Such collars require that the diodes in arrays thereof be spaced radially substantial distances apart. Such spacing is highly undesirable when an array of diodes is used to obtain greater microwave power output than one diode can provide and when the array must be compact. It is highly undesirable that the bore have irregular surfaces, such as screw threads, in the vicinity of the diode since such surfaces produce unwanted reflections of microwaves within the bore. It is, in any event, difficult to provide satisfactory electrical connection by contact between screw threads.

SUMMARY OF THE INVENTION

Accordingly, it is an object of the present invention to provide an improved inside collet assembly for coaxial placement of a diode or other electronic device.

Another object is to provide such an assembly for precisely positioning a generally cylindrical electronic device axially in a cylindrical cavity in electrical connection axially with a conductor within the cavity.

Another object is to provide such an assembly which mounts the device with its circumference in electrical and thermal connection with the side of the cavity.

Another object is to provide such an assembly having an overall diameter substantially no larger than the electronic device.

Another object is to provide such an assembly which does not cause undesired reflections of microwave energy within the cavity.

Yet another object is to provide such an assembly having the above advantages and adapted to rapidly and conveniently position the electronic device at different positions axially along the cavity and to withdraw the device therefrom when desired.

A further object is to provide such an assembly wherein all required manipulations of the assembly and the electronic device are performed from one axial end of the cavity.

BRIEF DESCRIPTION OF THE DRAWINGS

Other objects, advantages and novel features of the invention will become apparent from the following detailed description of the invention when considered in conjunction with the accompanying drawing figures, wherein.

DESCRIPTION OF THE PREFERRED EMBODIMENT

Figure 1:
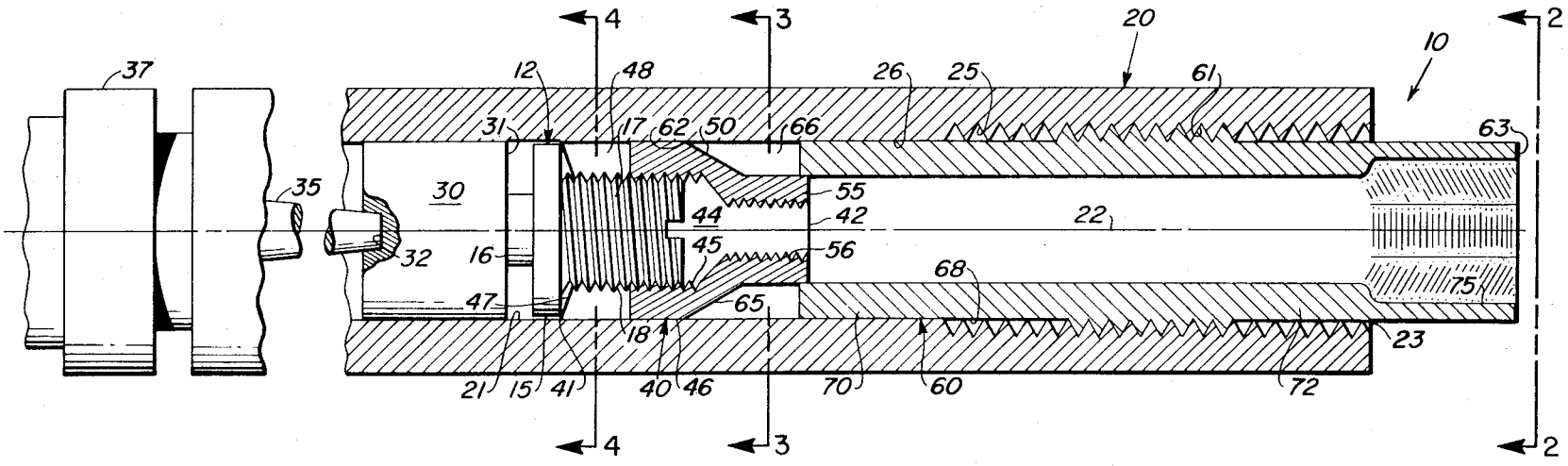
FIG. 1 is a sectional view of the invention in a representative operating environment, certain elements of the environment being unsectioned and broken for illustrative convenience at one side of the view.
Figure 2:
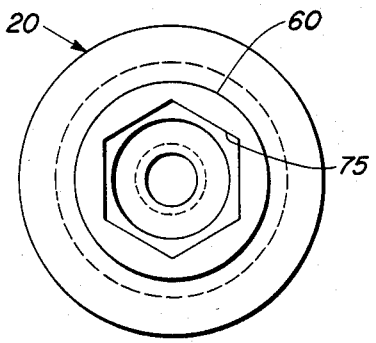
FIG. 2 is an end view taken from the position of line 2—2 of FIG. 1.
Figure 3:
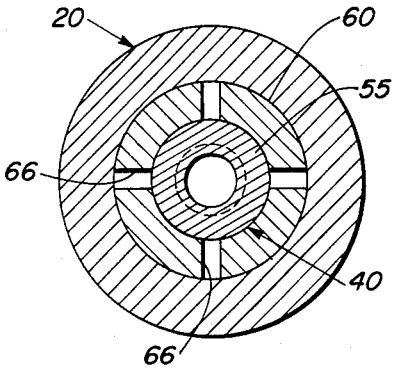
FIG. 3 is a section taken on line 3—3 of FIG. 1.
Figure 4:
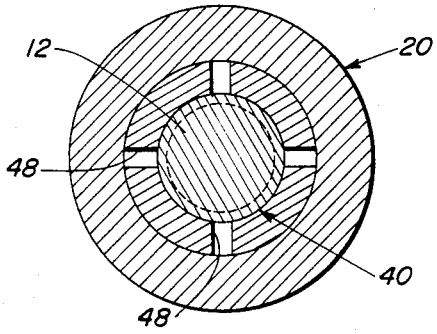
FIG. 4 is a section taken on line 4—4 of FIG. 1.

Referring to FIG. 1, an inside collet assembly 10 for the coaxial placement of an electronic device 12, such as an IMPATT diode, is shown in a representative operating environment.

Figure 5:
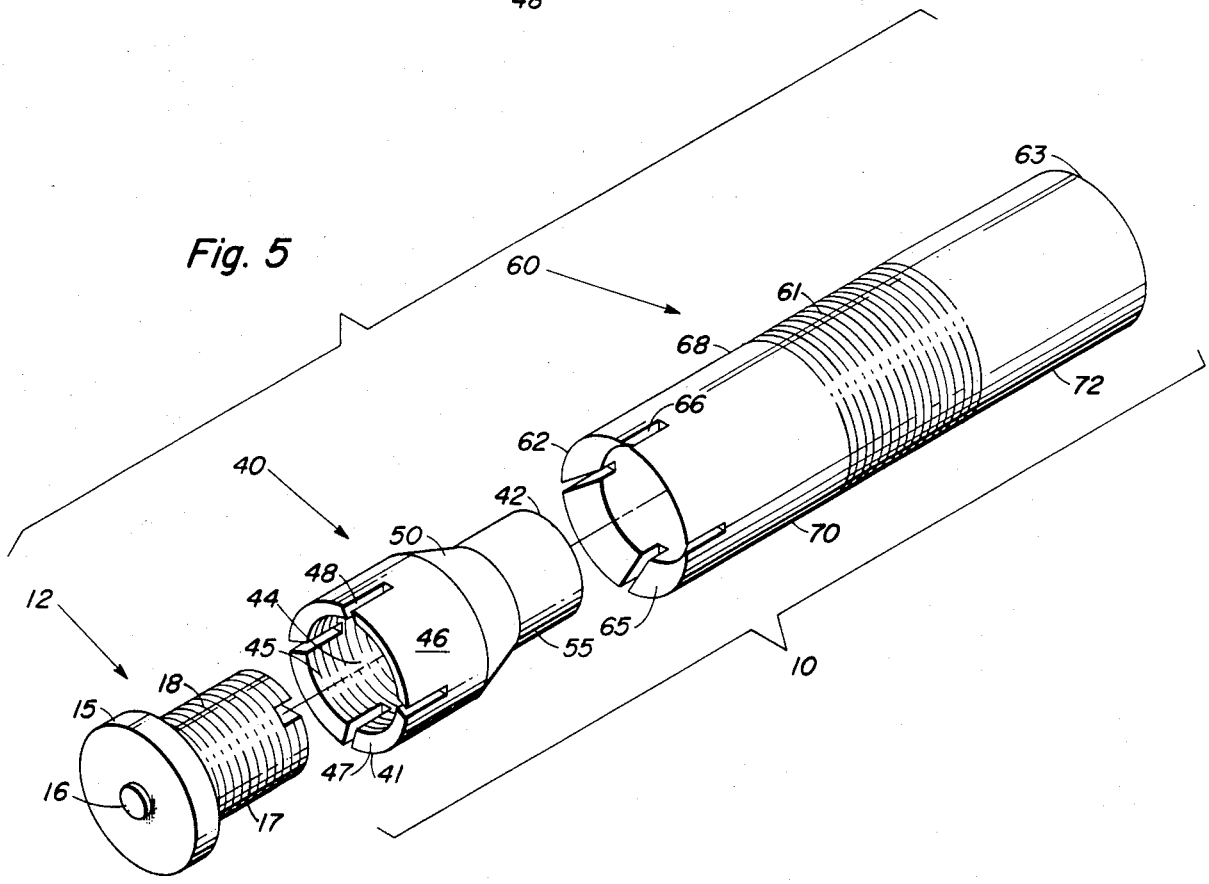
FIG. 5 is an exploded perspective view of a collet and a diode holder of the invention together with a diode.

Referring to FIGS. 1 and 5, it is seen that the diode 12 is generally cylindrical and has an axially central, annular flange 15. A projection which is electrically insulated from the balance of the diode exterior extends centrally and coaxially from the flange and terminates in a planar axial end or end surface 16 which is normal to the axis of the flange. The diode has a shank or axial end portion 17 extended oppositely of the flange from such surface and provided externally with screw threads 18 which are coaxial with the periphery of the flange and are substantially smaller in diameter than the periphery.

The operating environment includes an electrically conductive body 20 which is shown in FIGS. 1 through 4 and has within it an elongated and generally cylindrical cavity 21 having an axis 22 and an open end 23. The cavity has internal screw threads 25 extended therein from its open end for a portion of its length, the balance of the cavity being defined by a cylindrical surface 26 of the body, this surface being slightly larger in diameter than the flange 15 of the diode 12. The body, typically, is cooled in any suitable manner not relevant to the subject invention and, therefore, not shown.

The environment includes a transformer 30 which is an electrically conductive, cylindrical slug slidably received in the surface 26 of the cavity 21 and electrically insulated from the body 20, typically in a manner well known in the art, by a dielectric coating, such as plastic material, covering the cylindrical peripheral surface of the transformer. Transformer 30 provides a planar face 31 which is normal to the cavity axis 22 and faces towards and is spaced substantially from the open cavity end 23. The end of transformer 30 opposite such face has a central cylindrical depression 32. Body 20 has a tapered post 35 extended axially centrally through it from transformer 30 oppositely of the open cavity end. Post 35 has an end received in the depression. The body has a coaxial connector 37 of well known construction disposed oppositely of the cavity from the open end. The connector provides an outer conductor and a central conductor which are not shown but are understood to be connected electrically in any suitable manner, respectively, to the body 20 and to the post 35. The transformer is selected for impedance matching purposes from one of many transformers having varying distances between their respective depressions 32 and faces 31 so that the position of the face axially of the cavity is indeterminate in relation to the otherwise fixed dimensions of the cavity. It is apparent that the cylindrical surface 26 of the cavity, in any event, extends from the face of a particular transformer installed in the cavity towards the open cavity end. The diode 12 is mounted and positioned by the assembly 10, in a manner which is subsequently described, coaxially within the cavity with the diode end 16 facing the transformer face and flatly engaged therewith so that the diode shank extends centrally longitudinally of the cavity.

The assembly 10 has a diode holder 40 which is slidably received in the cavity 21 for movement along the axis 22 and has a first axial end 41 and a second axial end 42. When the holder is received in the cavity, these ends are disposed, respectively, toward the transformer face 31 and the open cavity end 23 so that these ends are spaced axially of the cavity. The holder has a socket 44 extended axially therein from its first end and opening through this end. The socket has internal screw threads 45 mating with the diode screw threads 18. The axial depth of the socket is somewhat greater than the axial length of the shank 17 so that the shank is wholly receivable in the socket. The holder has an external cylindrical surface 46 extending from its first end toward its second end and disposed in circumscribing, coaxial relation to the socket and approximately axially coextensive therewith. This cylindrical surface is somewhat larger in diameter than the diode flange 15 and is closely slidably fitted to the cavity cylindrical surface 26. The holder provides an annular beveled or frusto-conical interior end surface 47 disposed at its first end and extending between its socket and its exterior surface 46, the beveled surface converging inwardly from such exterior surface and away from this first end. The holder has four slots 48, best shown in FIGS. 4 and 5, spaced equally circumferentially about it and extended axially from its first end toward its second end and radially between its socket and its cylindrical exterior surface 46.

The holder 40 provides a frusto-conical exterior surface 50 coaxially related to the surface 46, the larger diameter of the frusto-conical surface being equal thereto and the frusto-conical surface converging therefrom in a direction toward the second holder end 42. The frusto-conical surface thus converges in a direction from the transformer face 31 toward the open end 23 of the cavity 21 when the holder is received therein. The holder has a cylindrical projection 55 extended from its second end 42 to its frusto-conical surface and substantially equal in diameter to the smaller end thereof. The holder has a screw threaded removal bore 56 extended axially into it from its second end within the projection.

The assembly 10 has an axially elongated, cylindrically tubular collet 60, which is shown in FIGS. 1, 2, 3, and 5, and which is receivable in the cavity 21 for movement along the axis 22 thereof. The collet has external screw threads 61 which mate with the screw threads 25 of the body 20 within the cavity 21 and which are disposed axially centrally of the collet. The collet has a holder engaging end 62 and an opposite drive end 63. The holder provides an internal frusto-conical or tapered interior surface 65 conforming to the surface 50 of the holder 40 and extended axially inwardly of the collet from its end 62. The holder has four slots 66 which extend radially outwardly through the holder from its frusto-conical surface and which extend axially from the holder engaging end. It is evident that the collet frusto-conical surface is disposed for engagement with the corresponding holder surface when the holder is received in the cavity. It is also apparent that the collet has a portion, indicated generally by the numeral 68, which extends from its frusto-conical surface toward the open cavity end 23 when the holder and collet are so engaged, and it is apparent that the cavity screw threads then circumscribe such portion. This collet portion continues oppositely of the collet end 62 from the collet screw threads toward the open cavity end so that such portion is disposed for engagement from a position externally of the body 20 for rotation of the collet. It can be seen that the cavity screw threads 25 and the collet screw threads 61 serve to connect the body and the collet portion 68 so that rotation of the collet in the appropriate direction moves it toward the transformer face 31.

The collet 60 has a stem 70 extended between its end 62 and its screw threads 61. This stem is slightly smaller in diameter than the cavity surface 21 and has an axial length such that, when the holder 40 is received by its surface 50 in the collet surface 65 and the diode 12 is received by its shank 17 in the holder socket 44 end with a transformer 30 of any length and with the cavity screw threads 25 engaged with the collet screw threads 61, the diode end 16 is engageable with the transformer face. The collet has a shank 72 which is receivable in the cavity 20. This shank extends from the collet screw threads oppositely of the stem to the collet drive end 63 a distance such that the shank protrudes from the open cavity end 23 for convenient grasping by the fingers when the diode end is engaged with the transformer face. The exterior diameter of the shank is substantially less than the collet screw thread diameter so that the greatest transverse dimension of the collet is at its external screw threads and is thus not substantially greater than the diameter of the cavity.

The collet 60 has a polygonal socket 75 extended within its shank 72 from its drive end 63 within its portion 68. The socket is thus adapted for engagement generally at the open cavity end 23 by a rotating tool such as a corresponding polygonal key, not shown, to rotate the collet when its screw threads 61 are engaged with the cavity screw threads 25.

OPERATION

Referring to FIGS. 1 and 5, and assuming that the diode 12 and collet assembly 10 are removed from the cavity 21 but that a desired transformer 30 is installed therein, the assembly is operated in a manner now to be described. Initially, the diode is screwed by its shank 17 into the socket 44 of the holder 40 so that the flange 15 engages the beveled holder surface 47 and, due to the slots 48, expands the holder so that the cylindrical holder surface 46 engages the cavity surface 26 radially of the beveled surface, when the diode and the holder are received in the cavity and when the diode end 16 is positioned against the transformer face 31, so that the flange is electrically and thermally connected to the body 20 through the holder 40.

The holder 40, which now carries the diode 12, is then placed in the collet 60 with the surfaces 50 and 65 engaged, and these elements are inserted into the cavity 20 from its open end 23 with the diode end 16 disposed to engage the transformer face 31 until the screw threads 25 and 61 engage. The collet is then rotated, by a suitable tool engaged in the socket 75 or by the fingers, until the diode end engages the transformer face. Such a tool is then utilized to further rotate the collet urging the diode against the transformer to ensure effective electrical connection therebetween and expanding the collet at its end 62 by wedging action of the frustoconical surfaces 50 and 65 outwardly into engagement with the body 20 at the surface 26 thus providing electrical and thermal connection between the diode shank 17 and the body through the holder and the collet.

If a transformer 30 of a different axial length is to be utilized, the collet 60 is rotated sufficiently in the reverse direction to loosen the collet from the cavity surface 26 and to allow the holder 40 and diode 12 to move together within the cavity 20 for insertion of the different transformer. The collet is then again rotated so as to engage the diode with this transformer and reengage the collet with the cavity surface.

If it is desired to replace the diode 12, the collet 60 is unscrewed from the cavity screw threads 25 and removed from the cavity 21, the holder remaining therein adjacent to the transformer face 30 together with the diode. Any suitable elongated instrument, not shown, having external screw threads engageable with the screw threaded removal bore 56 of the holder, is then inserted through the open cavity end and rotated so as to screw threadably engage the holder. The instrument is then withdrawn through this open end together with the holder and the diode.

It is evident from the foregoing that the assembly 10 serves to position the diode 12 precisely coaxially within the cavity 21 and axially thereof with the diode in electrical connection axially with the transformer 30 and with the circumference of the diode at its flange 15 and shank 17 in electrical and thermal connection to the body 20 at the side of the cavity. It is apparent that, since the assembly is not substantially larger in diameter than the cavity, the radial spacing required between a plurality of such assemblies which are parallel and closely adjacent is not significantly increased over the minimum spacing required by the diameter of diodes within the cavities. It will be noted that all required manipulations of the assembly to position the diode require access only to the open cavity end 23. It will also be noted that the cavity screw threads 25 are spaced substantially from the diode beyond the regions where it is electrically connected to the body by the holder 40 and the collet 60, so that these screw threads are not subjected to microwave energy within the cavity and do not cause reflections of this energy therein.

Obviously many modifications and variations of the present invention are possible in light of the above teachings. It is therefore to be understood that within the scope of the appended claims the invention may be practiced otherwise than as specifically described.

What is claimed is:

1. An inside collet assembly for positioning an electronic device in an elongated cavity provided by an electrically conducting body having an open end and in contact with an electrically conducting element having a face extended transversely of the cavity and disposed in an indeterminate position centrally thereof, the device having an end extended transversely of the cavity in facing relation to said face and an opposite end portion extending centrally longitudinally of the cavity and the assembly comprising:

(A) a holder which is slidably receivable in the cavity for longitudinal movement therein, the holder having a tapered exterior surface which converges in a direction from said face toward said open end when the holder is received in the cavity and defining a socket which is configured to receive said end portion of the device and opens toward said face when the holder is received in the cavity;

(B) a collet which is receivable in the cavity for movement longitudinally thereof, the collet having a tapered interior end surface which conforms to the tapered surface of the holder and is disposed for engagement therewith when the holder is received in the cavity and having a portion extending from said interior end surface oppositely of the holder toward said open end of the cavity; and (C) means connecting the body and said portion of the collet for moving the collet toward said face with the device received in said socket so that the tapered surfaces engage moving the holder toward said face together with the device so that said end thereof is urged into electrically conductive contact with the face and the collet expands within the cavity outwardly of the tapered surfaces by wedging action therebetween into engagement with the body so as to provide electrical and thermal connection between said end portion of the device and said body.

2. The assembly of claim 1 wherein said means for moving the collet comprises internal screw threads disposed on the body within the cavity and disposed in circumscribing relation to said portion of the collet when the collet is received in the cavity and external screw threads mounted on the collet and configured and disposed for screw threaded engagement with said internal screw threads, and wherein said portion of the collet is configured for engagement from a position externally of the body for rotation of the collet.

3. The assembly of claim 1 for use with such a cavity providing a cylindrical interior surface extended from said face of the electrically conductive element toward said open end of the cavity and with such an electronic device having an annular flange which is disposed between said end of the device and said end portion thereof and which is somewhat smaller in diameter than said cylindrical interior surface, and wherein the holder has an exterior cylindrical surface which is slidably fitted to said interior cylindrical surface and which circumscribes said socket and the holder has a frusto-conical interior end surface disposed to engage said flange and diverging outwardly from the socket to said exterior cylindrical surface so that the frusto-conical surface engages the flange to expand the holder thereabout for engagement of said exterior cylindrical surface and said interior cylindrical surface radially of the frusto-conical surface when the means for moving the collet toward said face urges the electronic device into contact therewith so that the flange is electrically connected to the body through the holder.

4. An inside collet assembly for positioning an electronic device within a generally cylindrical cavity within an electrically conductive body, the cavity having an open end and containing an electrically conductive element providing a face which is substantially normal to the axis of the cavity and is spaced substantially from said open end at an indeterminate position along the axis therefrom; the cavity having an interior cylindrical surface extended from the face toward the open end and having internal screw threads extended from said cylindrical surface to said open end; the device being generally cylindrical, having an axial end surface extending normally to said axis for engagement with said face, having an externally screw threaded shank disposed oppositely of said end surface, and having an annular flange which is disposed between said end and said end portion and which, peripherally, is somewhat smaller in diameter than said cylindrical surface of the cavity and is substantially larger than and coaxially related to said shank; and the assembly comprising:

a holder having opposite ends spaced axially of the cavity, a socket opening through one of said ends and having screw threads mating with the screw threads of the shank, an exterior cylindrical surface slidably fitted to the interior cylindrical surface of the cavity and extended from said one end of the holder toward the opposite end, a frusto-conical external surface extended from said exterior surface toward said opposite end and converging theretoward, the screw threads of the socket and said exterior surface and said frusto-conical surface being coaxially related and the holder having a plurality of circumferentially spaced slots extending axially from said one end toward said opposite end and radially between the socket and said exterior cylindrical surface; and a cylindrically tubular collet having axially centrally disposed external screw threads mating with the screw threads of the cavity, a holder engaging axial end, an opposite drive end, an internal frusto-conical surface conforming to the frusto-conical surface of the holder and extended inwardly from the holder engageable end, a plurality of circumferentially spaced slots extending radially outwardly through the holder from the internal frusto conical surface and axially from the holder engaging end, and rotating means disposed at said drive end for engagement at the open end cavity to rotate the collet when the screw threads thereof are engaged with the screw threads of the collet.

5. The assembly of claim 4 wherein the exterior cylindrical surface of the holder is somewhat larger in diameter than the periphery of the flange and the holder provides an annular beveled surface which is disposed at said one end of the holder and converges radially inwardly from said external surface and away from said one end so that, when the shank of the device is screw threadably engaged with the screw threads of the holder and rotated therein so as to engage the flange with the beveled surface, the flange expands the holder between the slots for engagement of said external surface with the cylindrical surface of the cavity when the device and holder are received therein.

6. The assembly of claim 4 wherein the collet has a portion extending from the screw threads thereof to the drive end thereof and receivable within the cavity and wherein the rotating means comprises a socket adapted for engagement by a rotating tool and extended axially inwardly of the collet from the drive end thereof within said portion of the collet so that the greatest transverse dimension of the collet is at the external screw threads thereof and is thus not substantially greater than the diameter of the cavity.

7. The assembly of claim 4 wherein the holder has an internally screw threaded bore extended axially therein from the end thereof opposite said one end thereof so that, when the holder is received in the cavity adjacent to said face of the electrically conductive element and is engaged peripherally with the cavity and the collet is remote therefrom, the holder is removable from the cavity through the open end thereof by engagement with an instrument which has external screw threads engageable with said bore and is inserted through said open end.

* * * * *